US007703524B2

(12) United States Patent
Parlin

(10) Patent No.: US 7,703,524 B2
(45) Date of Patent: Apr. 27, 2010

(54) CUTTING WINDOWS FOR LATERAL WELLBORE DRILLING

(75) Inventor: Joseph D. Parlin, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/124,810

(22) Filed: May 21, 2008

(65) Prior Publication Data

US 2009/0288829 A1 Nov. 26, 2009

(51) Int. Cl.
*E21B 23/04* (2006.01)
*E21B 33/14* (2006.01)

(52) U.S. Cl. ..... 166/285; 166/55.1; 166/242.1; 166/298; 175/62

(58) Field of Classification Search ..... 166/50, 166/55, 55.1, 117.6, 242.1, 242.5, 242.6, 166/285, 287, 297, 298, 313; 175/61, 62
See application file for complete search history.

(56) References Cited

U.S. PATENT DOCUMENTS

| | | | | |
|---|---|---|---|---|
| 2,007,465 A | | 7/1935 | Burt | |
| 4,671,367 A | | 6/1987 | Brunsing et al. | |
| 5,462,120 A | | 10/1995 | Gondouin | |
| 5,769,166 A | | 6/1998 | Duke | |
| 5,875,847 A | | 3/1999 | Forsyth | |
| 5,881,808 A | | 3/1999 | Rehbock | |
| 5,992,524 A | * | 11/1999 | Graham | 166/313 |
| 6,012,527 A | * | 1/2000 | Nitis et al. | 166/313 |
| 6,041,855 A | | 3/2000 | Nistor | |
| 6,308,782 B1 | * | 10/2001 | Brooks et al. | 166/313 |
| 6,913,082 B2 | * | 7/2005 | McGlothen et al. | 166/313 |
| 6,935,422 B2 | | 8/2005 | Steele et al. | |
| 2002/0056572 A1 | | 5/2002 | Hanton et al. | |
| 2004/0026090 A1 | * | 2/2004 | McGlothen et al. | 166/380 |
| 2004/0146367 A1 | | 7/2004 | Gerhardt et al. | |
| 2004/0168807 A1 | * | 9/2004 | McGlothen et al. | 166/313 |
| 2007/0181304 A1 | | 8/2007 | Rankin et al. | |

FOREIGN PATENT DOCUMENTS

| | | |
|---|---|---|
| WO | 9710409 A1 | 3/1997 |
| WO | 9809053 A2 | 3/1998 |
| WO | 03087524 A1 | 10/2003 |

OTHER PUBLICATIONS

Weatherford Multilateral Update, "Completion and Oilfield Services: Latin America," undated, 6 pages.

(Continued)

*Primary Examiner*—George Suchfield
(74) *Attorney, Agent, or Firm*—Marlin R. Smith

(57) ABSTRACT

A system and method for cutting windows for lateral wellbore drilling. A method of cutting a window through a sidewall structure for drilling a lateral wellbore through the window includes the steps of: providing an internal profile in the sidewall structure; then installing the sidewall structure in a parent wellbore; and then cutting the window through the sidewall structure, the cutting step including engaging a cutting tool with the internal profile. The cutting step may include resisting lateral displacement of the cutting tool due to engagement between the cutting tool and the internal profile.

24 Claims, 5 Drawing Sheets

OTHER PUBLICATIONS

Weatherford StarBurst Brochure, "StarBurst Multilateral System Overcomes Challenges to Create Deep Lateral Junction", 2007, 2 pages, Houston, Texas.

International Search Report and Written Opinion issued Jun. 26, 2009, for International Patent Application Serial No. PCT/US09/43074, 7 pages.

International Search Report and Written Opinion issued Jul. 6, 2009, for International Patent Application Serial No. PCT/US09/43097, 7 pages.

Office Action issued Oct. 5, 2009, for U.S. Appl. No. 12/124,895, 15 pages.

* cited by examiner

CUTTING WINDOWS FOR LATERAL WELLBORE DRILLING

BACKGROUND

The present disclosure relates generally to equipment utilized and operations performed in conjunction with subterranean wells and, in an embodiment described herein, more particularly provides for cutting windows for lateral wellbore drilling.

In the well-known process of drilling a lateral wellbore, a window is typically milled through the side of a casing string, and then the lateral wellbore is drilled by passing a drill string through the window. When milling through either "pre-milled" aluminum wrapped window joints or casing strings, it is often difficult to get a milling tool to start to cut, due to a tendency of the milling tool to "walk" in a direction of rotation of the milling tool. This situation is worsened by a mismatch between a curvature of the milling tool and a curvature of the material it is attempting to cut.

Lateral displacement of the milling tool during the milling operation causes the window to be malformed, leading to difficulties in passing the drill string through the window, installing completion equipment in the lateral wellbore, etc. Therefore, it may be seen that improvements are needed in the art of cutting windows for lateral wellbore drilling.

SUMMARY

In the present specification, a method of cutting windows for lateral wellbore drilling is provided which solves at least one problem in the art. One example is described below in which an internal profile is formed in a window joint for engagement with a cutting tool. Another example is described below in which engagement between an internal profile and a cutting tool prevents undesired lateral displacement of the cutting tool during a cutting operation.

In one aspect, a method of cutting a window through a sidewall structure is provided for drilling a lateral wellbore through the window. The method includes the steps of: providing an internal profile in the sidewall structure; then installing the sidewall structure in a parent wellbore; and then cutting the window through the sidewall structure. The cutting step includes engaging a cutting tool with the internal profile.

In another aspect, this disclosure provides a method of cutting a window through a sidewall structure for drilling a lateral wellbore through the window. The method includes the steps of: providing an internal profile in the sidewall structure; then installing the sidewall structure in a parent wellbore; and then cutting the window through the sidewall structure with a cutting tool. The cutting step includes resisting lateral displacement of the cutting tool relative to a longitudinal axis of the cutting tool due to engagement between the cutting tool and the internal profile.

These and other features, advantages, benefits and objects will become apparent to one of ordinary skill in the art upon careful consideration of the detailed description of representative embodiments hereinbelow and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
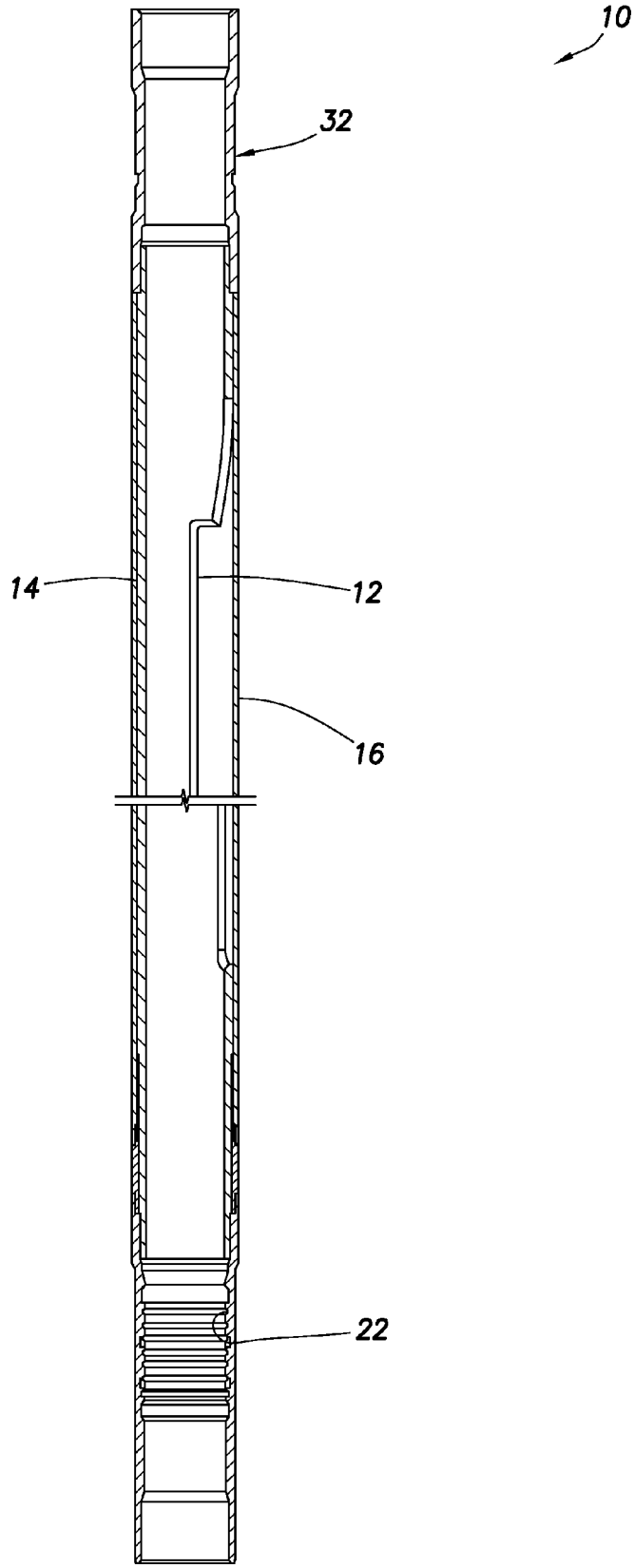
FIG. 1 (PRIOR ART)
FIG. 1 is a cross-sectional view of a prior art "pre-milled" casing joint.

Representatively illustrated in FIG. 1 is a prior art "pre-milled" window joint 10. The window joint 10 is described in U.S. Pat. No. 6,041,855, the entire disclosure of which is incorporated herein by this reference.

The window joint 10 is "pre-milled" in that it is provided with an opening 12 in an internal structural tubular member 14 of the window joint. The internal member 14 is typically made of steel.

Figure 2:
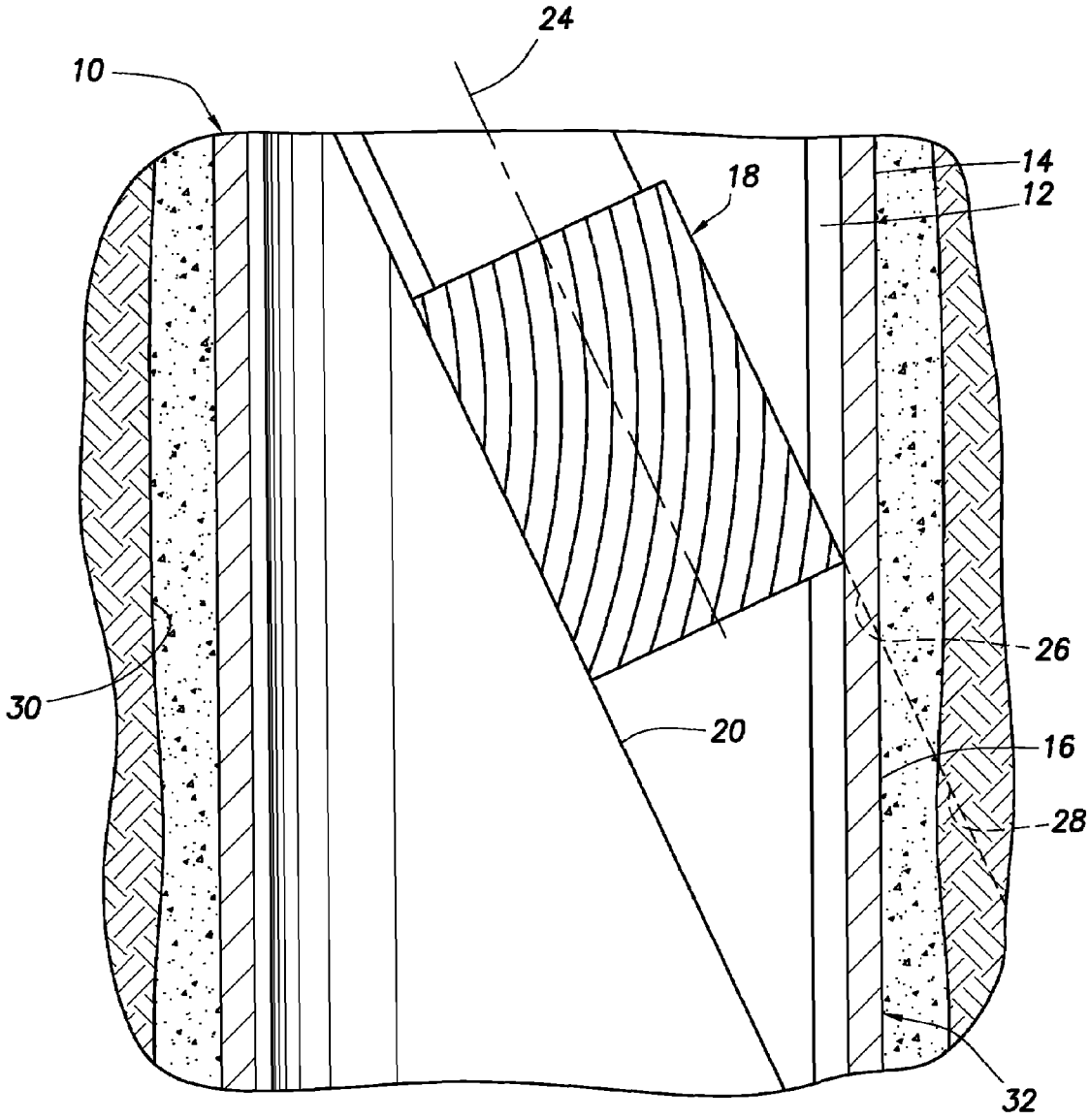
FIG.2 (PRIOR ART)
FIG. 2 is an enlarged scale schematic cross-sectional view of a prior art window milling operation.

In use, the window joint 10 is interconnected as a part of a casing string 32 positioned in a parent wellbore 30 (see FIG. 2). An external tubular member 16 is used to prevent fluid communication through the opening 12 while the window joint 10 is being conveyed into and positioned in a well, and while the window joint is cemented in the parent wellbore 30. The external member 16 is typically made of a relatively easily-millable material, such as an aluminum alloy or a composite material.

When it is desired to drill a lateral wellbore outwardly from the wellbore in which the window joint 10 is positioned, the external member 16 is milled through, and the lateral wellbore is drilled through the opening 12. The term "pre-milled" refers to the fact that it is not necessary to mill through the internal member 14 or any other difficult-to-mill material when initiating the lateral wellbore drilling process. Only the relatively easily-milled outer member 16 must be milled through.

Referring additionally now to FIG. 2, the milling process is schematically illustrated. In this view, a cutting tool 18, such as a mill, is being deflected toward the outer member 16 by a deflector 20, such as a milling whipstock.

The deflector 20 is secured relative to the window joint 10 by a latch (not shown) which is engaged with a latch coupling 22 (see FIG. 1). This engagement with the latch coupling 22 also azimuthally aligns a deflection face of the deflector 20 with the opening 12 in the internal member 14.

One problem with the milling process as depicted in FIG. 2 is that, when the cutting tool 18 begins to cut the external member 16, the cutting tool tends to "walk" along the surface of the member 16 in the direction of rotation of the cutting tool, causing the cutting tool to deflect laterally relative to a longitudinal axis 24 of the cutting tool. That is, as the cutting tool 18 rotates and bites into the surface of the member 16, the cutting tool is deflected across the surface of the member 16.

This causes the cutting tool 18 to cut an irregularly shaped window 26 through the member 16. The irregularly shaped window 26 creates difficulties for drilling, completing and producing operations in a lateral wellbore 28 extending outwardly from a parent wellbore 30 in which the window joint 10 is positioned.

Figure 3:
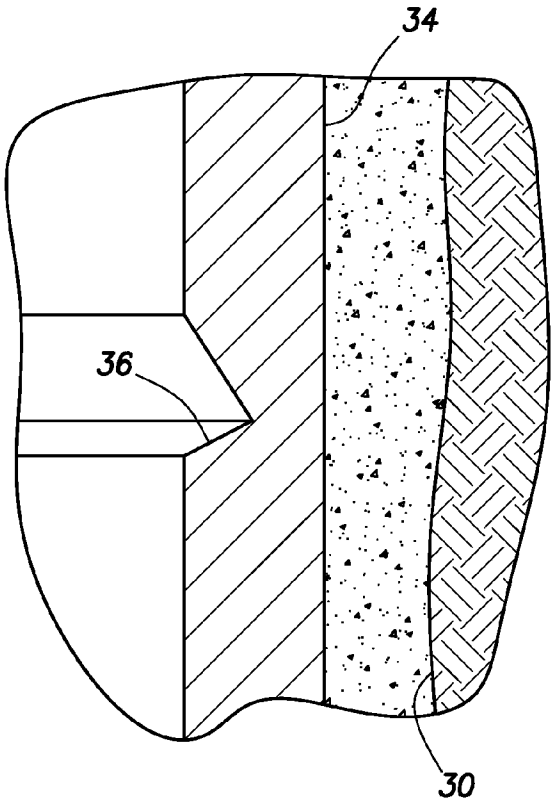
FIG. 3 is a schematic cross-sectional view of a system and method for cutting a window for lateral wellbore drilling, the system and method embodying principles of the present disclosure.

Referring additionally now to FIG. 3, a method embodying principles of the present disclosure is representatively illustrated. The method is for cutting the window 26 through a sidewall structure 34 for drilling the lateral wellbore 28 through the window.

The sidewall structure 34 may be used in the window joint 10 in place of the external member 16 described above. However, it should be understood that it is not necessary for the sidewall structure 34 to be tubular-shaped, to be positioned external to any other member, for the sidewall structure to be made of any particular material, or for the sidewall structure to include any particular characteristics of the external member 16. For clarity of description and convenience, the sidewall structure 34 and associated method are described below as if the sidewall structure is used in place of the external member 16 in the window joint 10.

As depicted in FIG. 3, the sidewall structure 34 has been cemented in the parent wellbore 30 as part of the casing string 32. As used herein, the term "cement" is used to indicate a material which seals and secures a tubular string in a wellbore. Cement may comprise a cementitious material and/or other types of materials, such as polymers, epoxies, etc. As used herein, the terms "casing," "casing string" and similar terms refer to generally tubular structures used to form a protective lining in a wellbore. Casing be made of any material, and can include tubulars known to those skilled in the art as casing, liner and tubing. Casing can be expanded downhole, interconnected downhole and/or formed downhole in some cases.

To help prevent the problems discussed above with milling through conventional window joints, the sidewall structure 34 is provided with an internal profile 36 in the form of a circumferentially extending notch or inclined shoulder. The profile 36 is preferably formed at a position where the cutting tool 18 will first contact the inner surface of the sidewall structure 34 in the milling operation to cut the window 26 through the sidewall structure.

This position for the profile 36 is determined from the geometry of the window joint 10, the deflector 20 and the cutting tool 18, as well as the spatial relationship of the latch coupling 22 relative to the sidewall structure 34. Engagement of the deflector 20 (or a latch associated therewith) with the latch coupling 22 will azimuthally and longitudinally align the cutting tool 18 with the profile 36 during the window cutting procedure.

Preferably, the profile 36 is formed in the sidewall structure 34 prior to conveying and positioning the window joint 10 in the parent wellbore 30.

In the window cutting procedure, the cutting tool 18 will engage the profile 36, and this engagement will prevent, or at least substantially reduce, lateral deflection of the cutting tool relative to the longitudinal axis 24 of the cutting tool. As such, engagement with the profile will prevent, or at least substantially reduce, displacement of the cutting tool 18 along the inner surface of the sidewall structure 34. This will allow a more uniform window 26 to be cut through the sidewall structure 34.

Figure 4:
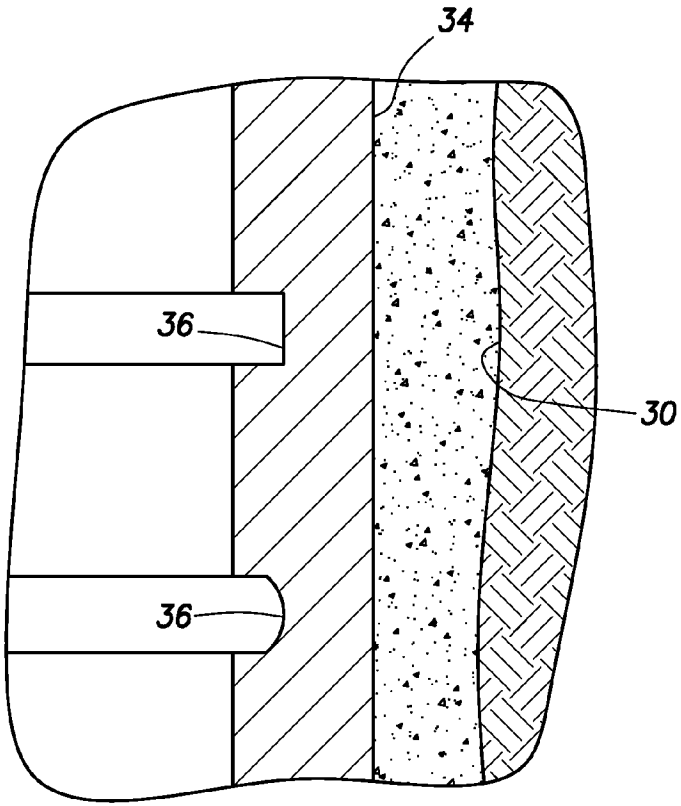
FIG. 4 is a schematic cross-sectional view of a second system and method for cutting a window for lateral wellbore drilling which embodies principles of the present disclosure.

Referring additionally now to FIG. 4, another configuration of the sidewall structure 34 is representatively illustrated. In this configuration, there are multiple profiles 36 formed in the sidewall structure 34. Multiple profiles 36 may be desirable when multiple cutting tools 18 are used to cut through the sidewall structure 34. For example, the multiple cutting tools 18 may have different diameters (so that they contact the sidewall structure at different positions), the cutting tools may have different shapes (so the profiles 36 may have corresponding complementary shapes), different deflectors 20 may be used to deflect the different cutting tools, etc.

Figure 5:
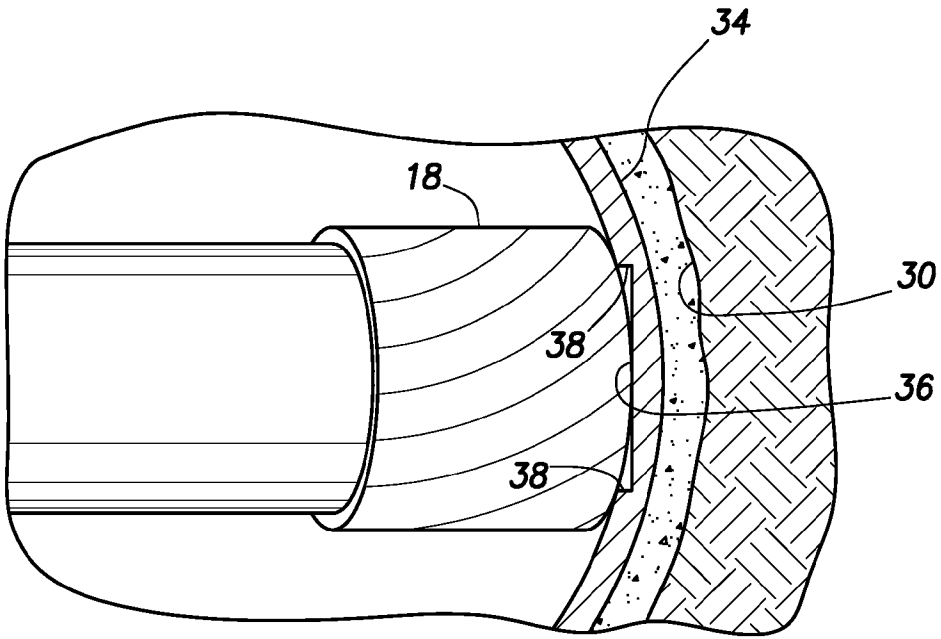
FIG. 5 is a schematic cross-sectional view of a third system and method for cutting a window for lateral wellbore drilling which embodies principles of the present disclosure.

Referring additionally now to FIG. 5, another configuration of the sidewall structure 34 is representatively illustrated. In this configuration, the profile 36 extends longitudinally along the inner surface of the sidewall structure 34, instead of circumferentially as in the configurations of FIGS. 3 & 4. The profile 36 of FIG. 5 includes shoulders 38 which help to prevent lateral displacement of the cutting tool 18 along the inner surface of the sidewall structure 34.

Figure 6:
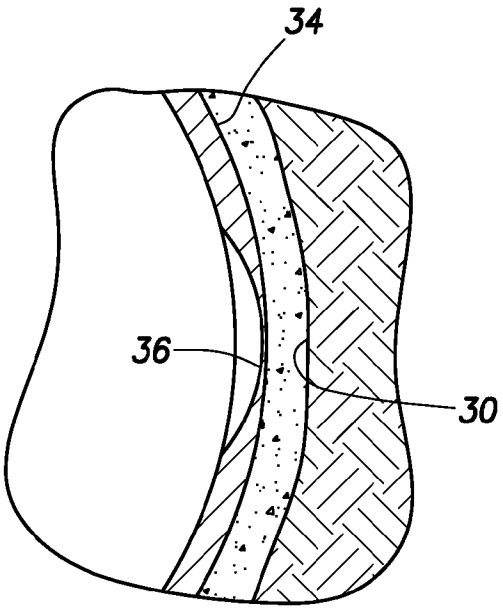
FIG. 6 is a schematic cross-sectional view of a fourth system and method for cutting a window for lateral wellbore drilling which embodies principles of the present disclosure.

Referring additionally now to FIG. 6, another configuration of the sidewall structure 34 is representatively illustrated. In this configuration, the profile 36 is spherical or bowl-shaped for cooperative engagement with the cutting tool 18.

Figure 7:
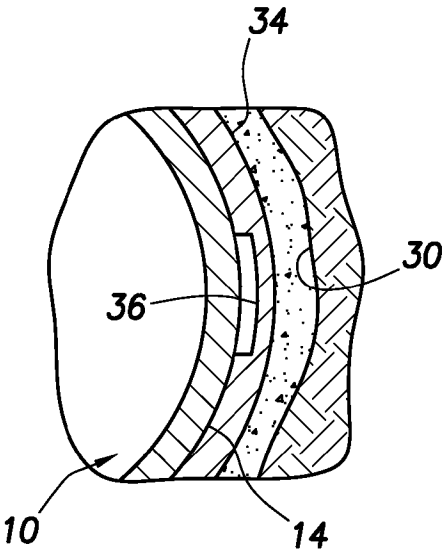
FIG. 7 is a schematic cross-sectional view of a fifth system and method for cutting a window for lateral wellbore drilling which embodies principles of the present disclosure.

Referring additionally now to FIG. 7, another configuration of the sidewall structure 34 is representatively illustrated. In this configuration, the profile 36 is somewhat similar to the profile of FIG. 5. FIG. 7 also shows that the sidewall structure 34 may be positioned external to the member 14 in the window joint 10, in which case the cutting tool 18 would displace through the opening 12 (see FIGS. 1 & 2) prior to engaging the profile 36 on the sidewall structure.

Figure 8:
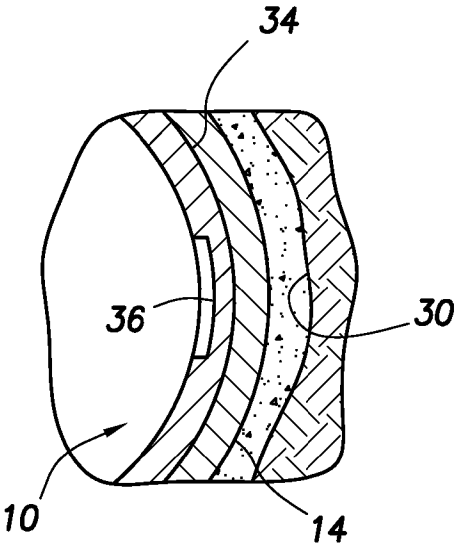
FIG. 8 is a schematic cross-sectional view of a sixth system and method for cutting a window for lateral wellbore drilling which embodies principles of the present disclosure.

Referring additionally now to FIG. 8, another configuration of the sidewall structure 34 is representatively illustrated in which the sidewall structure is instead positioned internal to the member 14. In this case, the cutting tool 18 would displace through the opening 12 (see FIGS. 1 & 2) after engaging the profile 36 and cutting through the sidewall structure 34.

Figure 9:
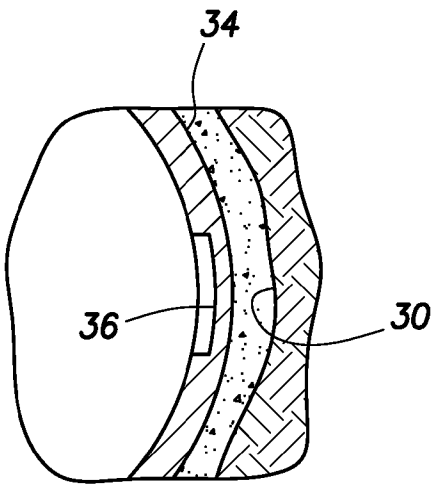
FIG. 9 is a schematic cross-sectional view of a seventh system and method for cutting a window for lateral wellbore drilling which embodies principles of the present disclosure.

Yet another configuration is representatively illustrated in FIG. 9, in which the sidewall structure 34 is used without the member 14. The sidewall structure 34 could be, for example, a section of casing or other tubular material which is provided with the profile 36 for enhancement of the milling operation.

In each of the configurations of the sidewall structure 34 described above, the sidewall structure is preferably made of a relatively easily-milled material, such as an aluminum alloy or a composite material. However, it should be understood that any material (e.g., steel, etc.) may be used in keeping with the principles of the present disclosure.

In each of the configurations of the sidewall structure 34 described above, the profile 36 preferably does not extend completely through the sidewall structure and is shaped so that the structural integrity of the sidewall structure is not compromised, so that normal operations (such as washing in the casing string 32, rotating the casing string, cementing, etc.) can be accomplished. However, fluid communication could be provided through the sidewall structure 34, if desired.

It may now be fully appreciated that the above disclosure provides substantial improvements to the art of drilling lateral wellbores. For example, the sidewall structure 34 and its associated internal profile 36 allow a uniform window to be milled through the sidewall structure.

In one aspect, the above disclosure provides a method of cutting a window 26 through a sidewall structure 34 for drilling a lateral wellbore 28 through the window. The method includes the steps of: providing an internal profile 36 in the sidewall structure 34; then installing the sidewall structure 34 in a parent wellbore 30; and then cutting the window 26 through the sidewall structure 34. The cutting step includes engaging a cutting tool 18 with the internal profile 36.

The providing step may include forming the internal profile 36 on the sidewall structure 34. Fluid communication through the sidewall structure 34 may be prevented after the forming step.

In the cutting step, engagement between the cutting tool 18 and the internal profile 36 may resist lateral displacement of the cutting tool relative to a longitudinal axis 24 of the cutting tool. Engagement between the cutting tool 18 and the internal profile 36 may resist displacement of the cutting tool along an internal surface of the sidewall structure 34.

In the cutting step, the cutting tool 18 may displace through an opening 12 formed through a sidewall of a generally tubular portion of a casing string 32 prior to engaging the internal profile 36. The cutting tool 18 may displace through the opening 12 formed through a sidewall of a generally tubular portion of a casing string 32 after cutting through the sidewall structure 34.

The installing step may include interconnecting the sidewall structure 34 in a casing string 32. The method may include cementing the casing string 32 in the parent wellbore 30 while the sidewall structure 34 prevents fluid communication between the interior and exterior of the casing string through the sidewall structure.

The providing step may include longitudinally extending the internal profile 36 along an interior surface of the sidewall structure 34. The providing step may include circumferentially extending the internal profile 36 along an interior surface of the sidewall structure 34.

The above disclosure also provides a method of cutting a window 26 through a sidewall structure 34 for drilling a lateral wellbore 28 through the window, with the method including the steps of: providing an internal profile 36 in the sidewall structure 34; then installing the sidewall structure 34 in a parent wellbore 30; and then cutting the window 26 through the sidewall structure 34 with a cutting tool 18. The cutting step includes resisting lateral displacement of the cutting tool 18 relative to a longitudinal axis 24 of the cutting tool, due to engagement between the cutting tool and the internal profile 36.

The providing step may include providing multiple internal profiles 36 in the sidewall structure 34. The cutting step may include cutting the window 26 through the sidewall structure 34 with multiple cutting tools 18, the cutting step including resisting lateral displacement of the cutting tools relative to the sidewall structure due to engagement between each of the cutting tools and a respective one of the internal profiles 36.

The providing step may include positioning the internal profile 36 in a known spatial relationship relative to a latch coupling 22. The method may include the step of engaging the latch coupling 22, thereby longitudinally and azimuthally aligning the cutting tool 18 with the profile 36.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of cutting a window through a sidewall structure for drilling a lateral wellbore through the window, the method comprising the steps of:

providing an internal profile in the sidewall structure;

then installing the sidewall structure in a parent wellbore; and then cutting the window through the sidewall structure, the cutting step including engaging a cutting tool with the internal profile.

2. The method of claim 1, wherein the providing step further comprises forming the internal profile on the sidewall structure, and wherein fluid communication through the sidewall structure is prevented after the forming step.

3. The method of claim 1, wherein in the cutting step, engagement between the cutting tool and the internal profile resists lateral displacement of the cutting tool relative to a longitudinal axis of the cutting tool.

4. The method of claim 1, wherein in the cutting step, engagement between the cutting tool and the internal profile resists displacement of the cutting tool along an internal surface of the sidewall structure.

5. The method of claim 1, wherein in the cutting step, the cutting tool displaces through an opening formed through a sidewall of a generally tubular portion of a casing string prior to engaging the internal profile.

6. The method of claim 1, wherein in the cutting step, the cutting tool displaces through an opening formed through a sidewall of a generally tubular portion of a casing string after cutting through the sidewall structure.

7. The method of claim 1, wherein the installing step further comprises interconnecting the sidewall structure in a casing string.

8. The method of claim 7, further comprising the step of cementing the casing string in the parent wellbore while the sidewall structure prevents fluid communication between the interior and exterior of the casing string through the sidewall structure.

9. The method of claim 1, wherein the providing step further comprises longitudinally extending the internal profile along an interior surface of the sidewall structure.

10. The method of claim 1, wherein the providing step further comprises circumferentially extending the internal profile along an interior surface of the sidewall structure.

11. The method of claim 1, wherein the providing step further comprises positioning the internal profile in a known spatial relationship relative to a latch coupling, and further comprising the step of engaging the latch coupling, thereby longitudinally and azimuthally aligning the cutting tool with the profile.

12. The method of claim 1, wherein the internal profile does not penetrate the sidewall structure.

13. A method of cutting a window through a sidewall structure for drilling a lateral wellbore through the window, the method comprising the steps of:

providing an internal profile in the sidewall structure;

then installing the sidewall structure in a parent wellbore; and then cutting the window through the sidewall structure with a cutting tool, the cutting step including resisting lateral displacement of the cutting tool relative to a longitudinal axis of the cutting tool due to engagement between the cutting tool and the internal profile.

14. The method of claim 13, wherein the providing step further comprises providing multiple internal profiles in the sidewall structure, and wherein the cutting step further comprises cutting the window through the sidewall structure with multiple cutting tools, the cutting step including resisting lateral displacement of the cutting tools relative to the sidewall structure due to engagement between each of the cutting tools and a respective one of the internal profiles.

15. The method of claim 13, wherein fluid communication through the sidewall structure is prevented after the providing step.

16. The method of claim 13, wherein in the cutting step, engagement between the cutting tool and the internal profile resists displacement of the cutting tool along an internal surface of the sidewall structure.

17. The method of claim 13, wherein in the cutting step, the cutting tool displaces through an opening formed through a sidewall of a generally tubular portion of a casing string prior to engaging the internal profile.

18. The method of claim 13, wherein in the cutting step, the cutting tool displaces through an opening formed through a sidewall of a generally tubular portion of a casing string after cutting through the sidewall structure.

19. The method of claim 13, wherein the installing step further comprises interconnecting the sidewall structure in a casing string.

20. The method of claim 19, further comprising the step of cementing the casing string in the parent wellbore while the sidewall structure prevents fluid communication between the interior and exterior of the casing string through the sidewall structure.

21. The method of claim 13, wherein the providing step further comprises longitudinally extending the internal profile along an interior surface of the sidewall structure.

22. The method of claim 13, wherein the providing step further comprises circumferentially extending the internal profile along an interior surface of the sidewall structure.

23. The method of claim 13, wherein the providing step further comprises positioning the internal profile in a known spatial relationship relative to a latch coupling, and further comprising the step of engaging the latch coupling, thereby longitudinally and azimuthally aligning the cutting tool with the profile.

24. The method of claim 13, wherein the internal profile does not penetrate the sidewall structure.

* * * * *